US007607390B2

(12) United States Patent
Donath et al.

(10) Patent No.: US 7,607,390 B2
(45) Date of Patent: Oct. 27, 2009

(54) PRINTING PRESS AND METHOD FOR OPERATING THE SAME

(75) Inventors: Michael Donath, Leimen (DE); Udo Greulich, Rauenberg (DE); Dieter Huber, Sinsheim (DE); Jürgen Michels, Dossenheim (DE); Dieter Schaffrath, Lorsch (DE); Wolfgang Schönberger, Schriesheim (DE); Bernhard Schwaab, Neustadt (DE); Michael Thielemann, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 11/729,392

(22) Filed: Mar. 28, 2007

(65) Prior Publication Data

US 2007/0227376 A1 Oct. 4, 2007

(30) Foreign Application Priority Data

Mar. 28, 2006 (DE) ..... 10 2006 014 649

(51) Int. Cl.
*B41F 31/03* (2006.01)
*B41F 31/04* (2006.01)
*B41F 31/02* (2006.01)

(52) U.S. Cl. ..... 101/352.13; 101/350.1; 101/DIG. 34

(58) Field of Classification Search ..... 101/DIG. 34, 101/350.1, 352.13, 352.1, 350.6
See application file for complete search history.

(56) References Cited

U.S. PATENT DOCUMENTS

| | | | | |
|---|---|---|---|---|
| 3,173,363 | A * | 3/1965 | Martin | 101/364 |
| 4,378,735 | A * | 4/1983 | MacPhee | 101/363 |
| 4,782,753 | A * | 11/1988 | Bolza-Schunemann | 101/363 |
| 4,958,561 | A | 9/1990 | Grosshauser et al. | |
| 5,615,611 | A | 4/1997 | Puschnerat | |
| 6,006,665 | A | 12/1999 | Stuchlik et al. | |
| 6,289,807 | B1 * | 9/2001 | Kutzner et al. | 101/350.1 |
| 6,705,223 | B2 | 3/2004 | Schönberger | |
| 2002/0108517 | A1 | 8/2002 | Schönberger | |
| 2006/0042488 | A1 | 3/2006 | D'Annunzio | |

FOREIGN PATENT DOCUMENTS

| | | |
|---|---|---|
| DE | 37 37 531 A1 | 5/1989 |
| DE | 44 38 262 C2 | 5/1996 |
| DE | 102 03 695 A1 | 8/2002 |
| EP | 1 632 351 A1 | 3/2006 |

* cited by examiner

*Primary Examiner*—Judy Nguyen
*Assistant Examiner*—Leo T Hinze
(74) *Attorney, Agent, or Firm*—Laurence A. Greenberg; Werner H. Stemer; Ralph E. Locher

(57) ABSTRACT

A printing press includes an anilox inking unit with an engraved roller and a doctor-type ink fountain. At least one stirring element projects into the doctor-type ink fountain.

1 Claim, 4 Drawing Sheets

PRINTING PRESS AND METHOD FOR OPERATING THE SAME

CROSS-REFERENCE TO RELATED APPLICATION

This application claims the priority, under 35 U.S.C. §119, of German Patent Application DE 10 2006 014 649.2, filed Mar. 28, 2006; the prior application is herewith incorporated by reference in its entirety.

BACKGROUND OF THE INVENTION

Field of the Invention

The present invention relates to a printing press including an anilox inking unit having an engraved roller and a doctor-type ink fountain. The invention also relates to a method for operating such a printing press.

The invention arose against the following background: At high machine speeds, an air layer which is entrained by the engraved roller surface is carried into a printing ink supply which is located in the doctor-type ink fountain and leads to disruption in the filling of cells of the engraved roller.

In order to solve that problem, it is proposed in German Published, Non-Prosecuted Patent Application DE 102 03 695 A1, corresponding to U.S. Pat. No. 6,705,223, to place an additional doctor before a metering doctor of the doctor-type ink fountain in the direction of rotation of the engraved roller. The additional doctor serves to strip the air layer entrained by the engraved roller surface off the outer peripheral surface, before the latter runs into the printing ink.

However, the additional doctor is not sufficiently effective to minimize the production of air bubbles in the printing ink supply caused by the air layer carried into the printing ink supply, to a sufficient extent. In particular, at high machine speeds, large air bubbles can be caused in the printing ink supply, which lead to complications. The complications are visible stripes extending on the printed sheet in the longitudinal direction of the latter.

The problem mentioned of the formation of air bubbles does not play any part in conventional offset inking units. In that connection, a conventional offset inking unit is understood to mean a ductor inking unit which includes a wedge-like ink fountain with an ink fountain roller and no engraved roller. The ink fountain roller rotates at a very slow speed. In such conventional offset inking units, problems can occur because of the thixotropy of the printing ink, in particular when the latter is a very viscous UV printing ink. In order to manage those problems, stirring elements projecting into the wedge-like ink fountain are used, as is shown, for example, in Japanese Published Patent Application JP 2001225448 A.

SUMMARY OF THE INVENTION

It is accordingly an object of the invention to provide a printing press having an anilox inking unit and a method for the operation of such a printing press, which overcome the hereinafore-mentioned disadvantages of the heretofore-known devices and methods of this general type and with which good printing quality is ensured even at high machine speeds.

With the foregoing and other objects in view there is provided, in accordance with the invention, a printing press. The printing press comprises an anilox inking unit having an engraved roller and a doctor-type ink fountain. At least one stirring element projects into the doctor-type ink fountain.

With the objects of the invention in view, there is also provided a method for operating a printing press. The method comprises providing an anilox inking unit having an engraved roller and a doctor-type ink fountain. A printing ink supply in the doctor-type ink fountain is stirred with a stirring element to minimize small air bubbles in the printing ink supply.

Through the use of the stirring element, the printing ink supply can be stirred thoroughly at high speed over the entire width of the doctor-type ink fountain, so that the formation of large air bubbles in the printing ink supply is reliably prevented. This advantageous effect is independent of the subject of the print and is even ensured at maximum machine speed. As a result, the occurrence of visible stripes in the printed image on the sheet, otherwise caused by air bubbles, is avoided.

Various developments of the printing press according to the invention and of the operating method according to the invention, are possible and are explained below.

The stirring element can be rod-shaped and have a round or polygonal cross section. However, the stirring element can also be a thin strip, for example made of sheet metal.

It is also possible to place a plurality of stirring elements beside one another within the doctor-type ink fountain in order to reduce the necessary stirring travel. The necessary stirring travel is that travel covered repeatedly by the respective stirring element during stirring. This stirring travel can also be referred to as the reciprocating width of the stirring element and is preferably greater than 7 centimeters. For example, the reciprocating width can be about 15 centimeters if three rod-shaped stirring elements project into the doctor-type ink fountain and the latter has a length of about 50 cm. On the other hand, however, the number of stirring elements should also not be too high.

The stirring element or each stirring element should be dimensioned in such a way that it reaches at least as far as the rotational center of the rotating roller of ink formed in the doctor-type ink fountain by the printing ink supply circulated by the engraved roller.

A mechanism can be provided on which the stirring element or each stirring element oscillates along the doctor-type ink fountain, that is to say in the direction substantially parallel to the axis of the engraved roller. This mechanism can include a pneumatic linear unit having a cam control system. The mechanism operates particularly quickly and reliably if it includes a stepping or servo motor in combination with a linear guide with a toothed belt drive. Likewise possible is a construction of the mechanism in the form of a linear guide with a screw gear mechanism or a construction as a linear motor or a construction using pull cables.

The mechanism can also include a carriage, to which the stirring element or each stirring element is fitted. The carriage can be guided by the linear guide mentioned previously, so that the carriage together with the stirring element or the stirring elements is moved back and forth along the doctor-type ink fountain.

In the structures mentioned previously, the stirring element or each stirring element is, so to speak, a linear oscillator. As an alternative to this, the stirring element or each stirring element can, however, also be mounted as a pendulum oscillator—that is to say in a manner similar to an automobile windshield wiper—and can thus be pivoted back and forth about a point of rotation in order to stir the printing ink.

In accordance with another feature of the invention, the anilox inking unit is placed against a printing form cylinder, the stirring element is mounted in such a way that it can move back and forth in a direction substantially parallel to the axis of the engraved roller, and the stirring element is driven in such a way that, at a specific machine speed, the stirring element executes a complete back and forth movement for at most five full revolutions of the printing form cylinder in each case—preferably for at most four full revolutions of the printing form cylinder in each case.

In accordance with a concomitant mode of the invention, the stirring element is moved back and forth along the doctor-type ink fountain so quickly that, at a specific machine speed, the stirring element executes a complete back and forth movement for at most five sheets printed in the printing press in each case—preferably for at most four sheets printed in the printing press in each case.

The specific machine speed at which the stirring element executes a complete back and forth movement for each previously defined number of cylinder revolutions or sheets can be the maximum printing speed which, for example, can be 15,000 prints per hour.

The speed of oscillation of the stirring element or each stirring element can be the same at each machine speed, that is to say tracking the speed of oscillation as a function of changes in the machine speed is not necessary.

The speed of oscillation and movement of the stirring element or each stirring element can therefore be constant, independent of the printing speed.

Other features which are considered as characteristic for the invention are set forth in the appended claims.

Although the invention is illustrated and described herein as embodied in a printing press and a method for operating the same, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
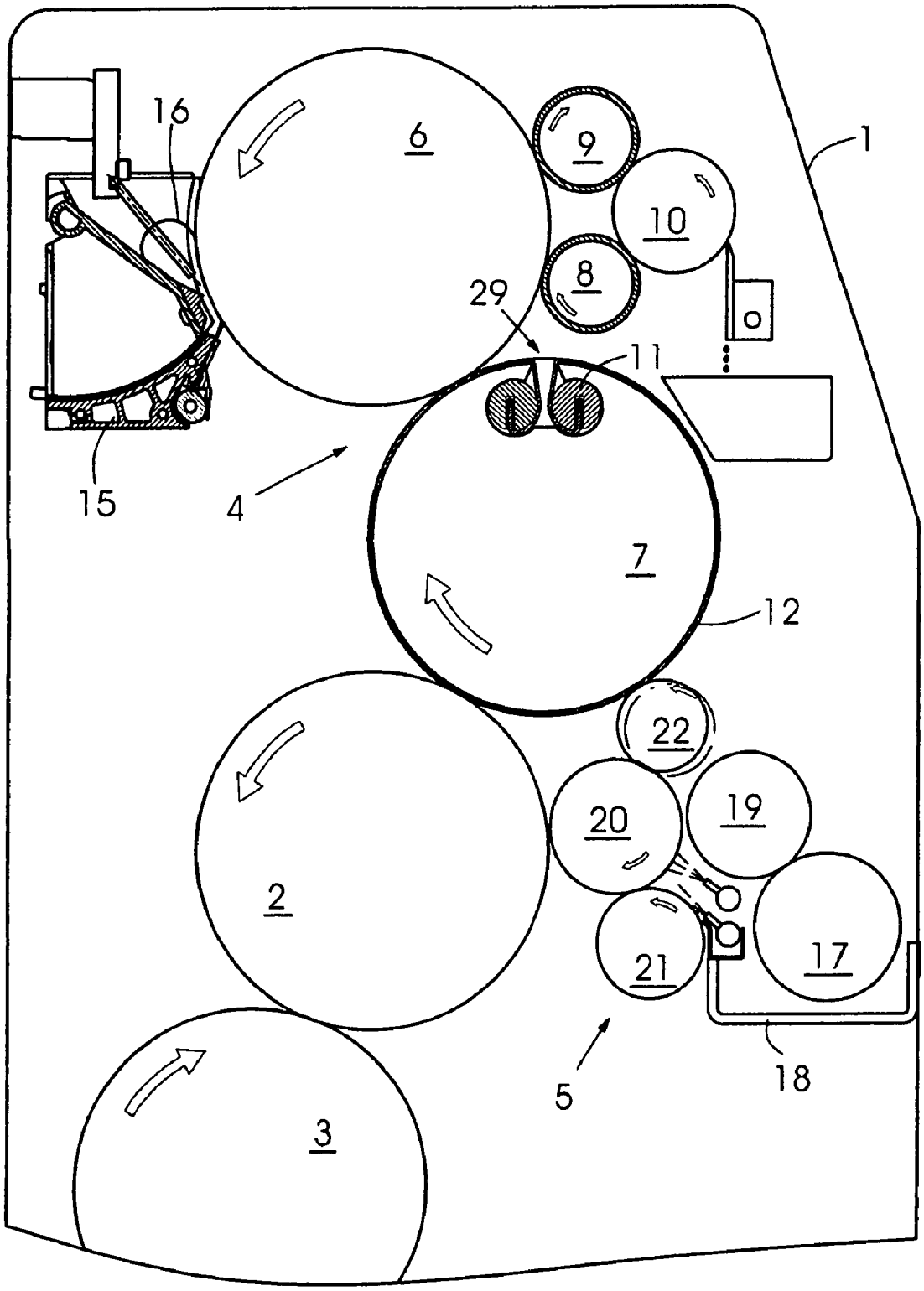
FIG. 1 is a diagrammatic, cross-sectional view of an offset printing unit having an anilox inking unit.

Referring now to the figures of the drawings in detail and first, particularly, to FIG. 1 thereof, there is seen a printing press 1 for offset printing, which includes a printing unit having a printing form cylinder 2, a blanket cylinder 3, an anilox inking unit 4 and a dampening unit 5. The anilox inking unit 4 includes an engraved or anilox roller 6 and an ink applicator roller or plate inking roller 7, which have the same diameter as the printing form cylinder 2. In addition, the anilox inking unit 4 includes a first roller 8, a second roller 9 and a third roller 10. The first roller 8 and the second roller 9 rest on the engraved roller 6, and the third roller 10 rests on the first roller 8 and on the second roller 9. The ink applicator roller 7 has a tensioning device 11 for tensioning a rubber blanket 12, which is seated in a cylinder channel 29 in the ink applicator roller 7. Furthermore, the anilox inking unit 4 includes a doctor-type ink fountain 15, which rests on the engraved roller 6 and holds a printing ink supply 16. The dampening unit 5 includes a dip roller 17 in a dampening solution fountain 18, a metering roller 19, a dampening solution applicator roller 20, a dampening solution distributor roller 21 which oscillates axially, and a bridging roller 22 for connecting the dampening solution applicator roller 20 to the ink applicator roller 7 in specific situations.

Figure 2:
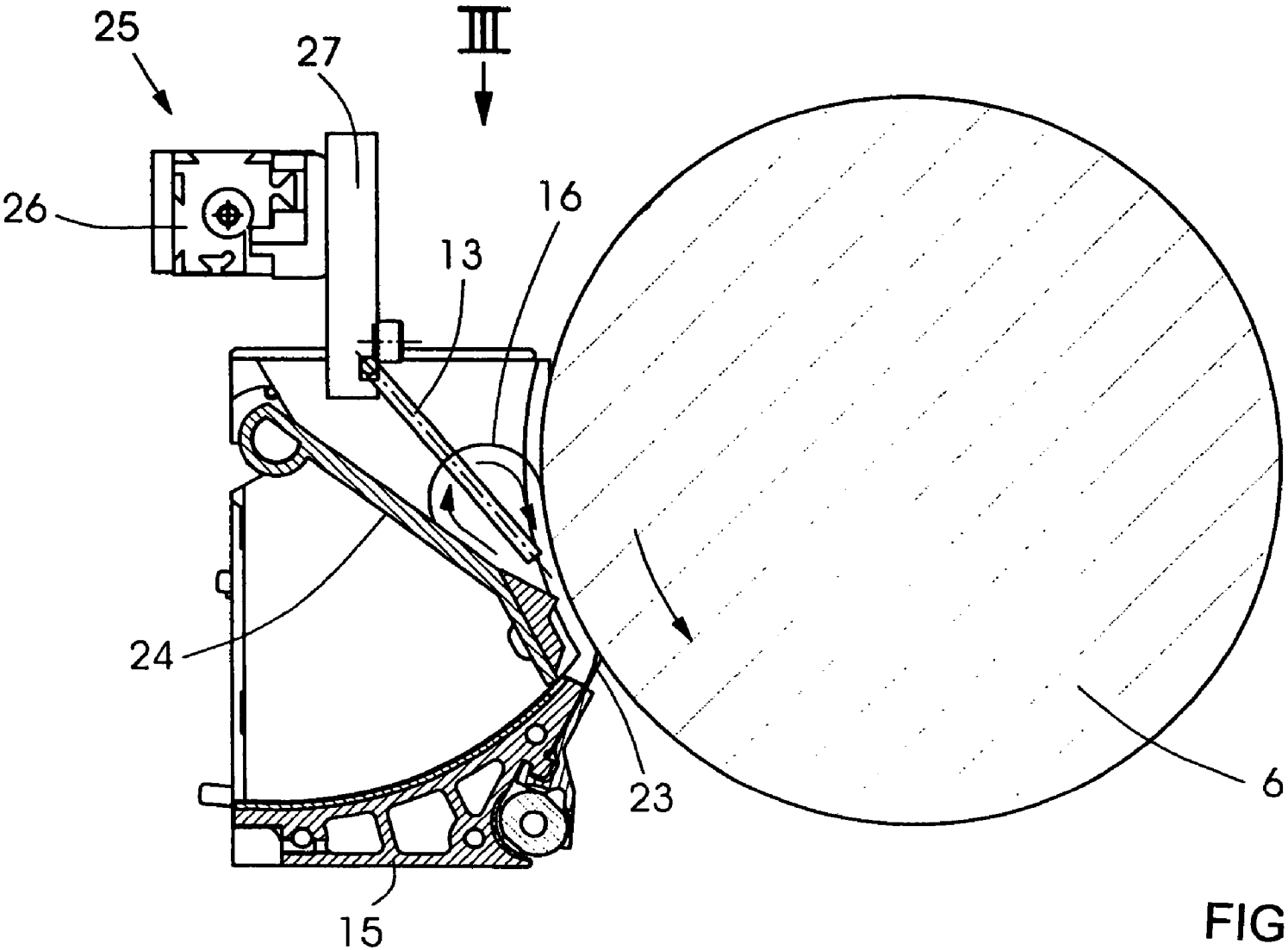
FIG. 2 is an enlarged, cross-sectional view of an engraved roller, a doctor-type ink fountain and a stirring device of the anilox inking unit of FIG. 1.

FIG. 2 shows that the doctor-type ink fountain 15 is equipped with a doctor 23 which bears on the engraved roller 6. In addition, the doctor-type ink fountain 15 includes a rear wall 24 which can be pivoted toward the engraved roller 6 in order to raise an ink level of the printing ink supply 16 above a blade of the doctor 23. The printing ink supply 16 forms a roller of ink, the rotation of which, indicated in the drawing by arrows, is driven by rotation of the engraved roller 6. A stirring device 25 for stirring the printing ink supply 16 includes a linear drive 26 which extends longitudinally, parallel to the axis of rotation of the engraved roller 6. In addition, the stirring device 25 includes a carriage 27, which is driven by the linear drive 26, so that the carriage 27 executes a back and forth movement along the linear drive 26. Fitted to the carriage 27 are three stirring elements 13, of which only one is visible in FIG. 2. It can be seen in FIG. 2 that this stirring element 13 projects into the roller of ink formed by the printing ink supply 16 and at the same time intersects an imaginary center about which the roller of ink rotates.

Figure 3:
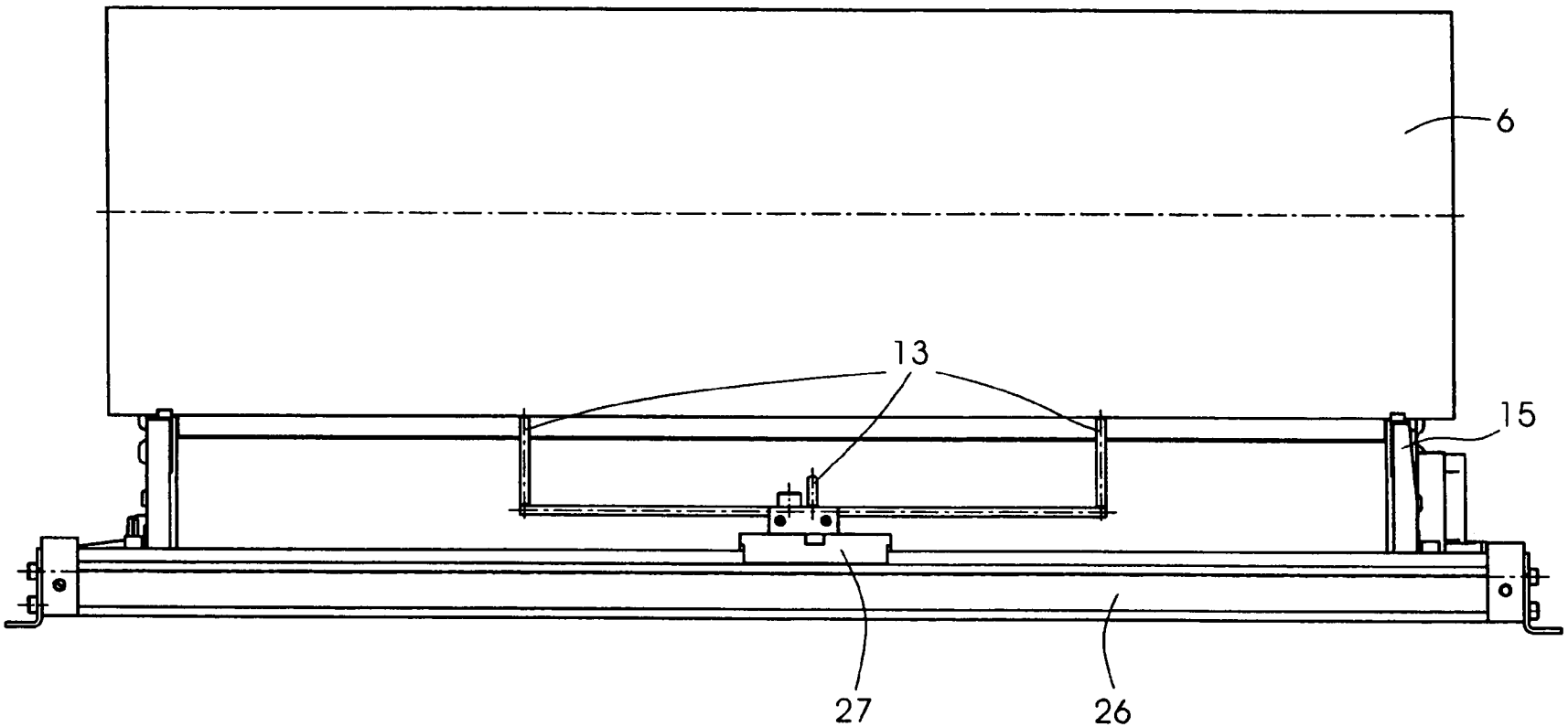
FIG. 3 is a plan view as seen in a viewing direction III in FIG. 2.

FIG. 3 shows that the stirring elements 13 are rod-shaped and form a type of multi-tined stirring rake. The reciprocating range of the back and forth movement of the carriage 27 and of the stirring elements 13 is dimensioned such that the latter stir the printing ink supply 16 substantially over an entire storage length of the doctor-type ink fountain 15. In FIG. 3, the carriage 27 is illustrated in a central position of its axial oscillation. In the course of this oscillating movement, the stirring element 13 located on the right in FIG. 3 almost reaches the right-hand side of the doctor-type ink fountain 15, and a point of reversal of the stirring element 13 located on the left is located close to a left-hand side wall of the doctor-type ink fountain 15. In the course of the oscillating movement, the central stirring element 13 sweeps over the positions of the two outer stirring elements 13 that are illustrated in FIG. 3 so that, during a complete back and forth movement, virtually no point along the printing ink supply 16 remains unstirred. The stirring elements move comparatively quickly during their back and forth movement. A stirring frequency is chosen to be so high that, at a specific machine speed, the carriage 27 executes at least one complete back and forth movement for five revolutions in each case—preferably even four or less revolutions in each case—of the printing form cylinder 2 (see FIG. 1). For example, in this case the carriage 27 and therefore each stirring element 13 executes one and one-half or more complete back and forth movements for at most four revolutions of the printing form cylinder 2 in each case. In this connection, a complete back and forth movement is understood to mean a complete linear oscillation or the period of this oscillation. During each revolution of the printing form cylinder 2, a printing material sheet is in each case printed in the printing press 1. The path speed at which the stirring elements 13 plow through the printing ink supply 16 can be so high, for example, that the stirring elements 13 move at about 1 meter per second at a printing speed of about 15,000 prints per hour.

Figure 4:
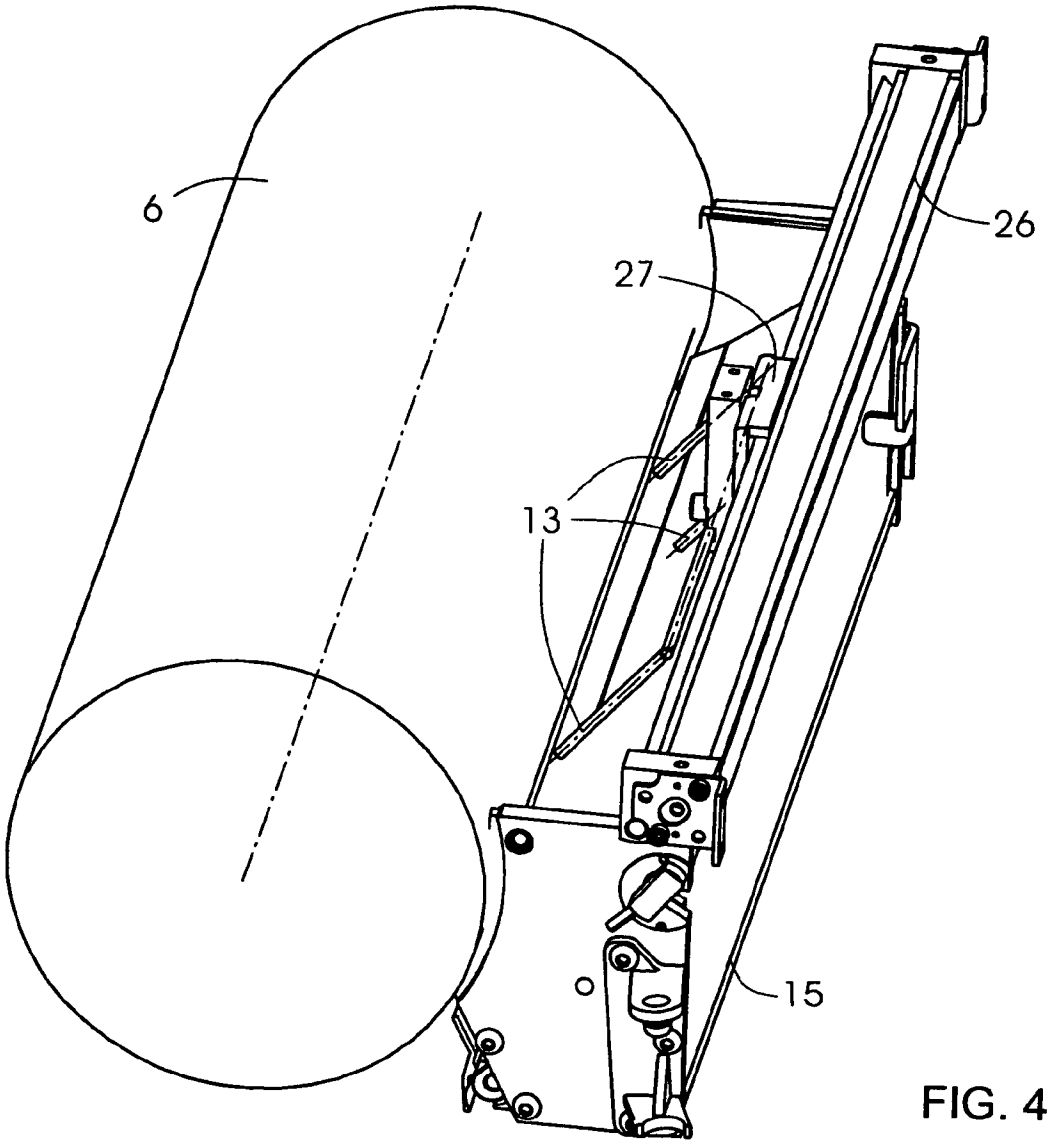
FIG. 4 is a perspective view of the engraved roller, the doctor-type ink fountain and the stirring device of FIGS. 2 and 3.

FIG. 4 shows the stirring device 25 in a perspective illustration, from which it can be seen that the two outer stirring elements 13 are oriented parallel to each other.

Air bubbles inevitably form in the printing ink supply 16 as a result of the inclusion of air layers carried along by the circumferential surface of the engraved roller. The action of the stirring device 25 is as follows: The number and the size of these air bubbles are reduced by the stirring elements 13 when the latter plow through the printing ink supply 16. The small air bubbles which possibly still remain after this are so few and so small that they do not impair the complete filling of the engraved depressions (cells or grooves) of the engraved roller 6, and therefore no longer cause any visible complications in the printed image on the printed sheet.

We claim:

1. A method for operating a printing press, the method comprising the following steps:

providing an anilox inking unit having an engraved roller and a doctor-type ink fountain;

providing a printing ink supply in the ink fountain;

forming a roller of ink in the printing ink supply driven by a rotation of the engraved roller; and stirring the printing ink supply in the doctor-type ink fountain with a stirring element reaching at least into the roller of ink to minimize small air bubbles in the printing ink supply;

moving the stirring element back and forth along the doctor-type ink fountain so quickly that, at a specific machine speed, the stirring element executes a complete back and forth movement for at most five sheets printed in the printing press.

* * * * *